US007162179B2

(12) United States Patent
Yoshida

(10) Patent No.: US 7,162,179 B2
(45) Date of Patent: Jan. 9, 2007

(54) IMAGE FORMING APPARATUS

(75) Inventor: Ken Yoshida, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/119,458

(22) Filed: May 2, 2005

(65) Prior Publication Data

US 2005/0254853 A1 Nov. 17, 2005

(30) Foreign Application Priority Data

May 17, 2004 (JP) ..... 2004-146223

(51) Int. Cl.
*G03G 15/01* (2006.01)
*G03G 15/16* (2006.01)
*G03G 21/00* (2006.01)

(52) U.S. Cl. ..... 399/101; 399/302; 399/346

(58) Field of Classification Search ..... 399/101, 399/297, 302, 346
See application file for complete search history.

(56) References Cited

U.S. PATENT DOCUMENTS 6,507,724 B1 * 1/2003 Tamura et al. ..... 399/297
6,597,885 B1 * 7/2003 Kai et al. ..... 399/277
2003/0180064 A1 * 9/2003 Hisakuni ..... 399/71
2004/0136760 A1 7/2004 Yoshida et al.
2004/0165919 A1 * 8/2004 Nishida ..... 399/346
2005/0013636 A1 1/2005 Sawai et al.

FOREIGN PATENT DOCUMENTS

JP 57-17973 1/1982
JP 7-271142 10/1995
JP 2001-75449 3/2001

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming apparatus includes a plurality of image carriers on each of which a toner image is formed based on image data; an intermediate transfer belt that is in contact with the image carriers, endlessly stretched over a plurality of rollers; a primary transfer unit that transfers the toner images to the intermediate transfer belt; a secondary transfer unit that transfers the toner images on the intermediate transfer belt to a recording medium at once; a cleaning blade that removes a residual toner on the intermediate transfer belt after a secondary transfer; and a lubricant supplying unit that supplies a lubricant to at least one of the image carriers and the secondary transfer roller, so that the lubricant is supplied to the intermediate transfer belt indirectly.

14 Claims, 4 Drawing Sheets

FIG.2

| CONDITION | LUBRICANT APPLICATION | | | DRAWBACK | | |
|---|---|---|---|---|---|---|
| | PHOTOSENSITIVE DRUM | INTERMEDIATE TRANSFER BELT | SECONDARY TRANSFER ROLLER | CURLING OF BLADE | WORMHOLE | TRANSFERABILITY |
| CONDITION 1 | ○ | ○ | ○ | ○ | × | × |
| CONDITION 2 | — | ○ | ○ | ○ | × | × |
| CONDITION 3 | ○ | ○ | — | ○ | × | × |
| CONDITION 4 | ○ | — | ○ | ○ | △ | △ |
| CONDITION 5 | — | — | ○ | ○ | ○ | ○ |
| CONDITION 6 | ○ | — | — | ○ | ○ | ○ |
| CONDITION 7 | — | ○ | — | ○ | × | × |
| CONDITION 8 | — | — | — | × | ○ | ○ |

IMAGE FORMING APPARATUS

CROSS-REFERENCE TO RELATED APPLICATIONS

The present document incorporates by reference the entire contents of Japanese priority document, 2004-146223 filed in Japan on May 17, 2004.

BACKGROUND OF THE INVENTION

1) Field of the Invention

The present invention relates to an image forming apparatus having a structure of a multi function product that includes all or at least two of the functions of an electronic copying machine, a printer, and a facsimile machine.

2) Description of the Related Art

Conventionally, an image forming apparatus using an intermediate transfer method is well known in which a toner image formed on an image carrier is transferred to an intermediate transferring body, and the toner image transferred to the intermediate transferring body is bulk transferred to a recording medium. In such type of the image forming apparatus, photosensitive drums, for example, are used as an image carrier with toner images formed thereon according to the image data, and an endless intermediate transfer belt stretched over a plurality of rollers is used, for example, as the intermediate transferring body. A transfer electric field formed between the photosensitive drum and the intermediate transfer belt during a primary transfer is used as a primary transfer unit that transfers the toner image of the photosensitive drum to the intermediate transfer belt, and a transfer electric field formed between the intermediate transfer belt and a transfer material is used as a secondary transfer unit that transfers the toner image of the intermediate transfer belt to the recording medium. The primary transfer unit needs to precisely and stably transfer the toner image formed on the photosensitive drum to the intermediate transferring body. Similarly, the secondary transfer unit also needs to precisely and stably transfer the toner image formed on the intermediate transferring body to the recording medium. In other words, a stable transfer with high transfer efficiency needs to be carried out to realize the performance of the primary and the secondary transfer units.

In the image forming apparatus that uses the intermediate transfer method, it is extremely difficult to attain a hundred percent transfer efficiency when the toner image is transferred to the recording medium by the secondary transfer unit, and after the secondary transfer, a part of the toner image invariably remains on the intermediate transfer belt, necessitating the inclusion of a belt cleaning device in the intermediate transfer belt. Cleaning blades are widely used as a belt cleaning device.

However, in such type of the belt cleaning device, curling or choking of the cleaning blade present obstacles for development. The technology of supplying a lubricant to the belt that is to be cleaned is widely known and is disclosed, for example, in Japanese Patent Laid-Open Publication No. S57-17973, Japanese Patent Laid-Open Publication No. H7-271142, and Japanese Patent Laid-Open Publication No. 2001-75449, to overcome this drawback.

However, since supplying a lubricant on the intermediate transfer belt reduces the surface friction coefficient of the belt, if the surface friction coefficient of the belt becomes too low as compared to the friction coefficient of the photosensitive drum surface, the primary transferability deteriorates, thereby causing image defects such as omission of image during transfer.

SUMMARY OF THE INVENTION

It is an object of the present invention to solve at least the above problems in the conventional technology.

An image forming apparatus according to one aspect of the present invention includes a plurality of image carriers on each of which a toner image is formed based on image data; an intermediate transfer belt that is in contact with the image carriers, and is endlessly stretched over a plurality of rollers; a primary transfer unit that transfers the toner images formed on the image carriers to the intermediate transfer belt; a secondary transfer unit that transfers the toner images on the intermediate transfer belt to a recording medium at once; a cleaning blade that removes a residual toner on the intermediate transfer belt after the secondary transfer unit transfers the toner images on the intermediate transfer belt to the recording medium; and a lubricant supplying unit that supplies a lubricant to at least one of the image carriers and the secondary transfer roller, so that the lubricant is supplied to the intermediate transfer belt indirectly.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 2 is a table of a relation between lubrication conditions and blade curling, wormhole, and transferability (transfer efficiency);

DETAILED DESCRIPTION

Exemplary embodiments of the present invention are explained below in detail with reference to the accompanying drawings.

Figure 1:
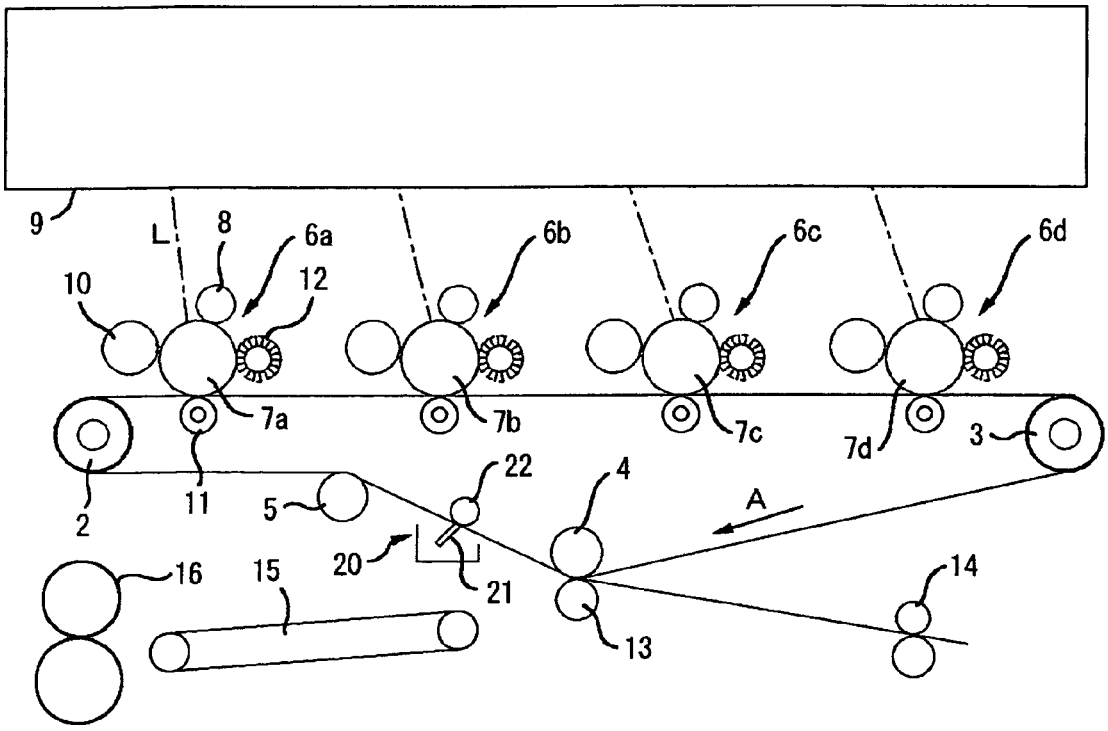
FIG. 1 is a schematic of a main unit of an image forming apparatus according to the present invention.

FIG. 1 is a schematic of a main unit of an image forming apparatus according to the present invention. An image forming unit of the image forming apparatus shown in FIG. 1 includes an intermediate transfer belt 1 as an image carrier that is stretched over rollers 2, 3, 4, and 5. One of the rollers 2 and 3, as a driving roller, rotates in the direction of an arrow A by rotating in clockwise direction. Further, the image forming unit includes four image creating units 6A, 6B, 6C, and 6D facing the upper running side of the intermediate transfer belt 1. The four image creating units 6A, 6B, 6C, and 6D include photosensitive drums 7A, 7B, 7C, and 7D as image carriers. A magenta toner image, a cyan toner image, a yellow toner image, and a black toner image are formed respectively on each of the photosensitive drums.

Since the four image creating units 6A, 6B, 6C, and 6D form the toner image on the image carrier by means of the same structure and process, only the structure of the first image creating unit 6A that forms the toner image on the photosensitive drum 7A is explained. As shown in FIG. 1, the photosensitive drum 7A is driven to rotate in anticlockwise direction, and the surface of the image carrier is uniformly charged to a predetermined polarity by a charging roller 8. Next, the charged surface is exposed to a light modulated laser beam L emitted from a laser writing unit 9. Thus, an electrostatic latent image is formed on the photosensitive drum 7A that is converted by a developing unit 10 into a visualized image, for example, as a magenta toner image.

An electric voltage with reversed polarity as that of the toner is applied to a transfer roller 11 located between the photosensitive drum 7A and the intermediate transfer belt 1, thereby transferring the magenta toner image formed on the photosensitive drum 7A to the intermediate transfer belt 1. A cleaning device 12 removes the residual toner remaining on the photosensitive drum 7A that is not transferred to the intermediate transfer belt 1.

Similarly, the other image creating units 6B, 6C, and 6D form the cyan toner image, the yellow toner image, and the black toner image on the photosensitive drums 7B, 7C, and 7D respectively. These toner images are transferred with a sequentially superposed on the intermediate transfer belt 1 with the transferred magenta toner image. The toner images of the four colors thus formed on the intermediate transfer belt 1 are carried by the running belt to a secondary transfer unit that includes a secondary transfer roller 13 shown in the extreme right of FIG. 1.

A not shown sheet feeder is provided in the lower part of the main image forming unit, and a recording material P in the form of transfer sheets, for example, is supplied from the sheet feeder. The recording material P comes in contact with a resist roller 14, and is sent to the secondary transfer unit of the intermediate transfer belt 1 in appropriate timing for transfer of the toner images to the recording material P. An electric voltage of opposite polarity to that of the toner on the intermediate transfer belt 1 is applied to the secondary transfer roller 13, thereby transferring the superposed toner images transferred on the intermediate belt 1 to the recording material P. The recording material P with the transferred toner images is conveyed to a fixing device 16 by means of a conveying belt 15 where the toner images are fixed, and discharged to a not shown sheet discharge unit etc.

The residual toner that is not transferred to the recording material P after the secondary transfer is removed by a belt cleaning device 20. The belt cleaning device 20 includes a cleaning blade 21 that scrapes the intermediate transfer belt 1. A backup roller 22 ensures that the intermediate transfer belt 1 is properly scraped.

Polyimide is used as a material for the intermediate transfer belt 1. Carbon black is dispersed in a polyamic-acid bath, and the dispersion liquid is poured into a metallic drum and dried. The film separated from the metallic drum is elongated under high temperature to form a polyimide film. The polyimide film is cut to an appropriate size to make an endless belt formed of polyimide resin. In the commonly used method for film formation, a polymer solution with dispersed carbon black is poured into a circular metallic mold, and the circular metallic mold is rotated while being heated to 100–200° C. to form a film by means of centrifugal molding. The film thus obtained is removed from the mold in semi cured condition, covered with iron core, and cured by subjecting to poly reaction at 300–450° C. degrees to form the intermediate transfer belt 1. Changing the amount of carbon, the calcinations temperature, the curing rate, etc. can control the resistance of the belt. The surface friction coefficient of the belt thus formed is 0.45. The surface friction coefficient is measured by means of HEIDON TRIBOGEAR μs 94i manufactured by Shin Tokagaku.

Blade curling may occur in the image forming apparatus employing the intermediate transfer method that uses the cleaning blade 21 in the belt cleaning device 20. The curling is largely attributed to the surface friction coefficient of the intermediate transfer belt 1. Usually a lubricant is applied to the intermediate transfer belt 1 to reduce the surface friction coefficient, thereby preventing the occurrence of curling.

A local omission of the toner image, a so-called wormhole phenomenon, may occur in the primary transfer unit of the image forming apparatus that uses the intermediate transfer method. Repeated experiments by the inventor indicate that the increase in the amount of the lubricant attached to the surface of the intermediate transfer belt 1 increases the likelihood of occurrence of the wormhole phenomenon.

Thus, the present invention aims to achieve compatibility between the prevention of the wormhole and the prevention of curling of the cleaning blade 21 that are mutually contradictory. The exemplary embodiments of the present invention are explained next.

FIG. 2 is a table of a relation between lubrication conditions and blade curling, wormhole, and transferability (transfer efficiency), according to a first embodiment of the present invention. As shown in FIG. 2, conditions 1 through 8 represent the conditions of lubricant application to the photosensitive drums 7, the intermediate transfer belt 1, and the secondary transfer roller 13, a circle indicating that the part is lubricated and a dash indicating that the part is not lubricated. In other words, the intermediate transfer belt 1 is lubricated in conditions 1 through 3. The photosensitive drums 7 and the secondary transfer roller 13 are also lubricated in condition 1. The secondary transfer roller 13 is lubricated in condition 2, and the photosensitive drums 7 are lubricated in condition 3. Further, the intermediate transfer belt 1 is not lubricated in conditions 4 through 6, the photosensitive drums 7 and the secondary transfer roller 13 are lubricated in condition 4, only the secondary transfer roller 13 is lubricated in condition 5, and only the photosensitive drums 7 are lubricated in condition 6. Only the intermediate transfer belt 1 is lubricated in condition 7, and neither the intermediate transfer belt 1, nor the photosensitive drums 7, and nor the secondary transfer roller 13 is lubricated in condition 8.

The drawbacks column of FIG. 2 indicates the result of an evaluation of blade curl, wormhole, and transferability (transfer efficiency) corresponding to conditions 1 through 8, a circle representing "problem not observed", a triangle representing "within permissible limits", and a cross representing "outside permissible limits".

According to the evaluation results, blade curl is not observed under conditions 1 through 3 and condition 7, but the degree of wormhole and primary transferability are not outside permissible limits. The wormhole is not observed and primary transferability (transfer efficiency) is good under condition 8, but the degree of blade curl is outside permissible limits. The blade curl, the wormhole, and the transferability (transfer efficiency) are all within permissible limits under conditions 4 through 6. These observations indicate that the primary transfer defects such as the wormhole as well as the blade curl can be prevented by lubricating either the photosensitive drums 7 or the secondary transfer roller 13 or both. It can also surmised from the observation that the wormhole and the transferability (transfer efficiency) are slightly more of a problem under condition 4 as compared to conditions 5 and 6 that while it is most preferred to lubricate either the photosensitive drums 7 or the secondary transfer roller or both, lubricating the photosensitive drums 7 and the secondary transfer roller 13 is the next preferred option.

Thus, under conditions 4 through 6, the lubricant spreads to the surface of the intermediate transfer belt 1 from the photosensitive drums 7 or the secondary transfer roller 13 causing indirect lubrication, thereby reducing the surface friction coefficient to a level that does not harm the primary transferability, thus making conditions 4 through 6 the most preferred. The surface friction coefficient of the intermediate transfer belt 1 under each of the conditions shown in FIG. 2 is measured and the relation of the surface friction coefficient with the level of wormhole is examined to confirm whether indeed conditions 4 through 6 are the most preferred. The result is shown in FIG. 3.

Figure 3:
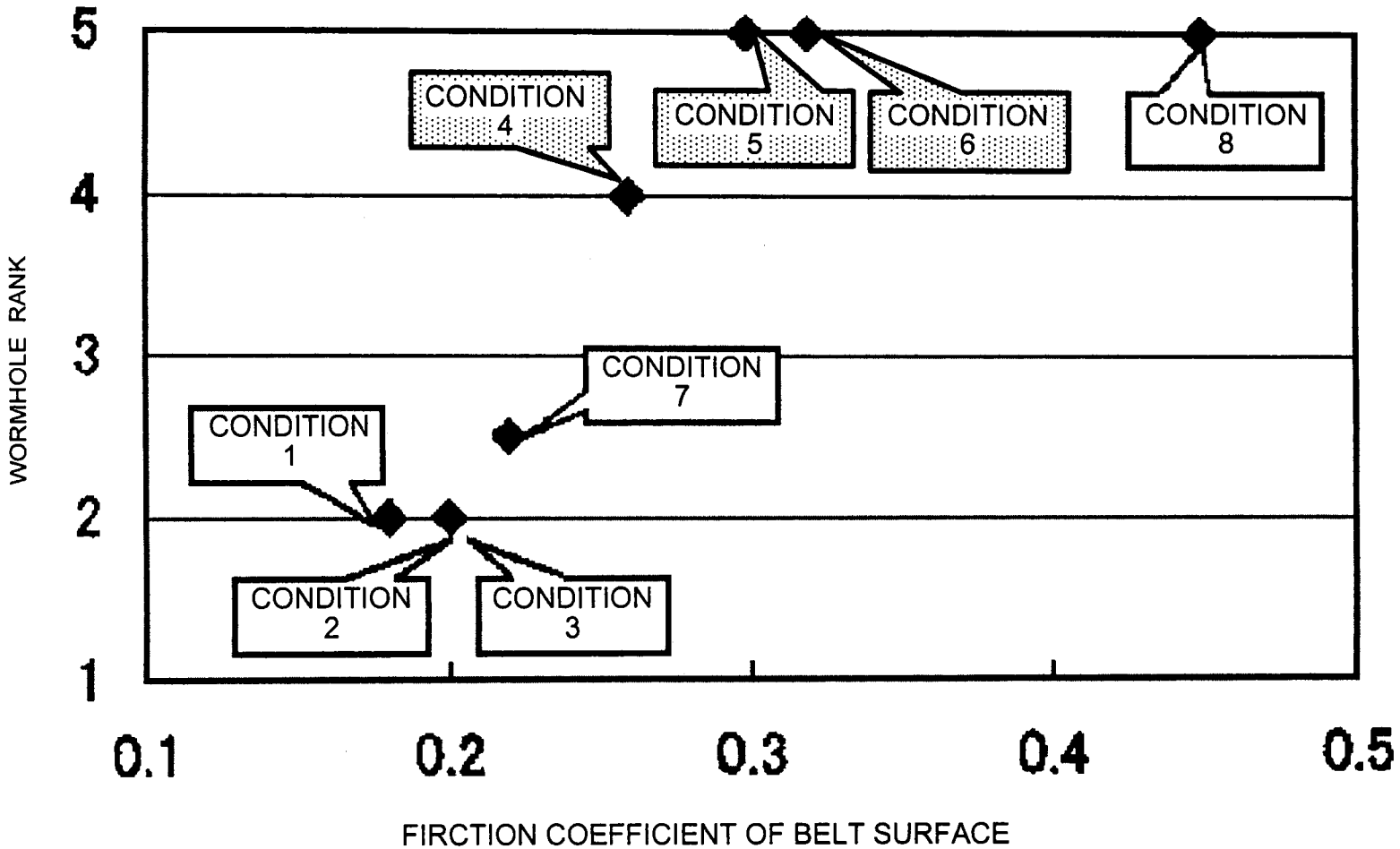
FIG. 3 is a graph of a relation between surface friction coefficient of an intermediate transfer belt and wormhole.

FIG. 3 is a graph of a relation between surface friction coefficient of an intermediate transfer belt and wormhole. As shown in FIG. 3, a wormhole rank indicates the occurrence level of wormhole evaluated on a scale of 5, 1 denoting the worst level and 5 denoting the best level. Under conditions 1 through 3, and 7 in which the intermediate transfer belt 1 is lubricated, the surface friction coefficient of the intermediate transfer belt 1 is low as compared to that under other conditions and the wormhole is worse. Under condition 4 in which the photosensitive drums 7 and the secondary transfer roller 13 are lubricated, the surface friction coefficient of the intermediate transfer belt 1 is high as compared to that under conditions 1 through 3, and 7, and the wormhole also improves. Under conditions 5 and 6 in which either the photosensitive drums 7 or the secondary transfer roller 13 is lubricated, the surface friction coefficient of the intermediate transfer belt 1 is greater than that under condition 4, and accordingly the wormhole improves further. Under condition 8 in which no part is lubricated, the surface friction coefficient of the intermediate transfer belt 1 further increases than that under condition 4, but has caused blade curl. Thus, it is confirmed that by lubricating either the photosensitive drums 7 or the secondary transfer roller 13 or both, the intermediate transfer belt 1 is indirectly lubricated, thereby reducing the surface friction coefficient to a level that does not harm the primary transferability and preventing the primary transfer defects such as wormhole as well as blade curl.

According to the structure of the first embodiment, it is evident that the primary transfer defects such as wormhole as well as blade curl can be prevented by lubricating either the photosensitive drums 7 or the secondary transfer roller 13 or both. However, blade curl may still occur if a toner input amount of the cleaning blade 21 is extremely small, such as during a continuous passage of blank sheets etc.

In a structure according to a second embodiment of the present invention, which includes a control mechanism, an image creating unit 6 forms the toner image between the images, the toner image that is formed is transferred to the intermediate transfer belt 1, and passed along to the cleaning blade 21 of the intermediate transfer belt 1 as a blade input pattern. The rest of the structure is the same as that shown in FIG. 1.

The toner image formed between the images is a beta image with an area of 3 mm in the direction of rotation multiplied by the entire axis width, and is formed at a rate of one toner image every 10 sheets.

When ten thousand blank sheets are passed on the intermediate transfer belt 1 of the image forming apparatus of structures according to the first and the second embodiments, and the effect of the blade input pattern on blade curl is evaluated, it is observed that blade curl occurs mid course in the image forming apparatus having a structure according to the first embodiment, but does not occur in the image forming apparatus having a structure according to the second embodiment. Thus, it is confirmed that blade curl can be convincingly prevented by forming the blade input pattern.

Since blade curl is likely to occur during an image creation mode with less opportunity for indirect lubrication (time when the secondary transfer roller 13 is in contact with the intermediate transfer belt is less), the image density (adhering toner amount per unit area), the image area, and the input interval can be changed according to the image creation mode, and the toner input amount of the cleaning blade 21 can be increased during the image creation mode with less opportunity for indirect lubrication.

The image creation modes are, for example, a black and white mode and a full color mode. In the full color mode, there is a gap between the images to some extent in order to ensure fixability, but in the black and white mode, the gap between the images is narrowed to enable passage of maximum number of sheets. Since in the black and white mode, the gap between the sheets reduces during the continuous passage of sheets, the time during which the secondary transfer roller 13 is in contact with the intermediate transfer belt 1 is reduced, thereby especially reducing the indirect lubrication from the secondary transfer roller 13. In the black and white mode, indirect lubrication from the photosensitive drums 7 is difficult because of the image portion. Therefore, even if a lubricating unit is provided in the photosensitive drum 7, the amount of lubrication decreases due to the reduction of the non-image portion. Hence, the toner input amount of the blade is varied for the color mode and the black and white mode.

The difference in image creation modes also includes modes with different numbers of continuous sheets fed. For example, during the 100 sheets are continuously fed, the gap between the images differs when images of different content are to be continuously formed on the 100 sheets, and when images with the same content are to be continuously formed on the 100 sheets. Accordingly, the toner input amount of the blade is varied by selecting appropriate image creation modes.

Changing the toner input amount is equivalent to changing the image density, the image area, and the input interval of the blade input pattern. Changing the image density is equivalent to changing the adhering toner amount per unit area. The adhering toner amount increases for the black and white mode and for a mode with large number of sheet feed. However, the capability of the developing device limits the changing of the image density.

Changing the image area is equivalent to increasing the width in the direction of rotation to more than 3 mm when the usual area of the blade input pattern is 3 mm in the direction of rotation multiplied by the entire axis width. The capability of the developing unit does not limit the changing of the image area, and the desired toner input amount can be obtained.

Finally, changing the input interval is equivalent to narrowing the input interval of the blade input pattern from once every 10 sheets to, for example, once every 5 sheets for the mode that requires increased toner input amount. Changing the input interval is also not limited by the capability of the developing device, and the desired toner input amount can be obtained.

Thus, forming a toner image between the images and passing the formed toner image into the cleaning blade 21 of the intermediate transfer belt 1 can prevent blade curl without reducing the surface friction coefficient of the intermediate transfer belt 1.

According to a third embodiment of the present invention, a secondary transfer roller is lubricated. The rest of the structure is the same as that shown in FIG. 1.

When the blade input pattern is formed and input into the cleaning blade 21, the input pattern formed on the intermediate transfer belt 1 comes in contact with the secondary transfer roller 13 before being input into the cleaning blade 21, thereby causing the toner of the input pattern to adhere to the surface of the secondary transfer roller 13. The adhering toner spreads to the backside of the recording material P, thereby soiling the recording material P. Thus, a cleaning unit is also needed for the secondary transfer roller 13. A cleaning blade is the most commonly used cleaning unit. However, the diameter of the secondary transfer roller 13 is generally smaller than that of the photosensitive drums 7 or the intermediate transfer belt 1 in order for recording medium to separate from the secondary transfer roller 13 and avoid winding around it. Thus, using the cleaning blade as the cleaning unit for the secondary transfer roller 13, a risk of the blade curl becomes high. To overcome the drawback, the secondary transfer roller 13 is lubricated.

Figure 4:
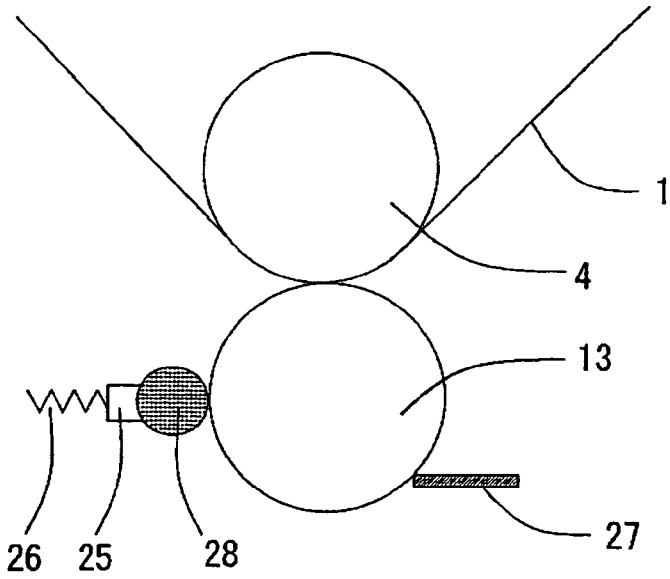
FIG. 4 is a schematic of a secondary transfer unit of the image forming apparatus according to the present invention.

FIG. 4 is a schematic of a structure for lubricating the secondary transfer roller 13. A lubricant 25 is pressure welded to a lubricating brush 28 by means of a compressed spring 26, and the secondary transfer roller 13 is lubricated by means of the lubricant 25 scraped by the lubricating brush 28. Thus, the surface friction coefficient of the secondary transfer roller 13 is reduced due to the effect of the lubricant 25, and the curling of a cleaning blade 27 can be prevented.

Since the recording medium in the form of sheets come in between the secondary transfer roller 13 and the intermediate transfer belt 1, paper dust may adhere to the secondary transfer roller 13. The paper dust may coat the cleaning blade 27 and harm the cleaning ability of the cleaning blade 27. Since paper dust can be removed by means of the lubricating brush 28, harming of the cleaning ability of the cleaning blade 27 can also be prevented in addition to the preventing blade curl.

According to a fourth embodiment of the present invention, a secondary transfer roller is lubricated in a structure t. The rest of the structure is the same as that shown in FIG. 1.

Figure 5:
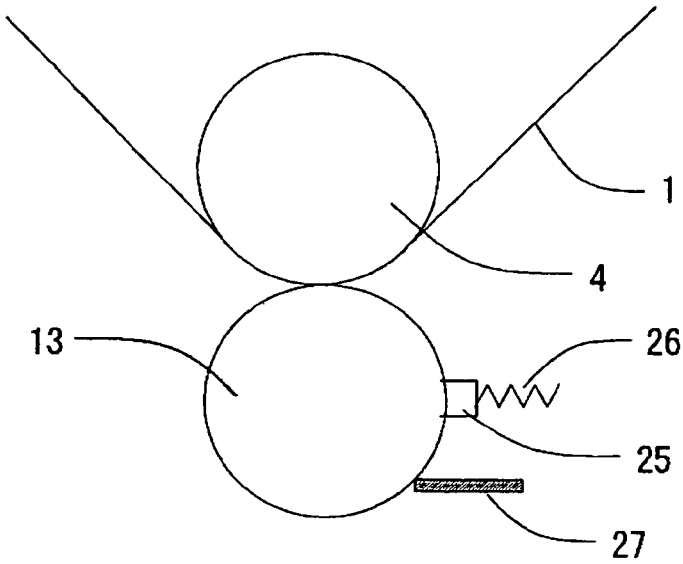
FIG. 5 is a schematic of another secondary transfer unit of the image forming apparatus according to the present invention.

A structure to lubricate the secondary transfer roller 13 is shown in FIG. 5. The lubricant 25 is pressure welded to the secondary transfer roller 13 by means of the compressed spring 26, and the secondary transfer roller 13 is lubricated by means of the lubricant 25. Thus, the surface friction coefficient of the secondary transfer roller 13 is reduced due to the effect of the lubricant 25, and the curling of the cleaning blade 27 can be prevented.

Since the lubricating brush is not needed, the image forming apparatus according to the fourth embodiment is space-effective as well as cost-effective as compared to the image forming apparatus according to the third embodiment.

In the structure according to the third and the fourth embodiments, since the blade input pattern may get transferred to the secondary transfer roller 13, the toner input amount the cleaning blade 27 of the intermediate transfer belt is reduced to even less than the amount when the toner image is formed, thereby resulting in a high probability of blade curl. To increase the toner input amount, it is possible to form more toner images. However, the method of forming more toner images results in a wasteful consumption of the toner, thereby increasing the cost of a single copy.

According to a fifth embodiment of the present invention, the toner input amount of the cleaning blade 27 without any significant change in the toner input amount as compared to that during the image formation, and the curling of blade of the intermediate transfer belt can be prevented convincingly.

According to the present invention, primary transfer defects such as wormhole (loss of image during transfer) and blade curl can be prevented.

Furthermore, according to the present invention, blade curl can be convincingly prevented by reducing the surface friction coefficient of the intermediate transfer belt without harming the primary transferability.

Moreover, according to the present invention, a blade curl can be prevented.

Furthermore, according to the present invention, a curling of the blade of the secondary transfer roller can be prevented.

Furthermore, according to the present invention, a harming of the cleaning ability of the cleaning blade due to the adhering paper dust can be prevented.

Moreover, according to the present invention, the need for a lubricating member such as a brush is obviated, thereby lowering the cost.

Furthermore, according to the present invention, the lubricant on the surface of the secondary transfer roller spreads to the intermediate transfer belt, and curling of the blade of the intermediate transfer belt can be convincingly prevented.

Moreover, according to the present invention, the toner input amount of the cleaning blade of the intermediate transfer belt can be increased, and blade curl can be convincingly prevented.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a plurality of image carriers on each of which a toner image is formed based on image data;

an intermediate transfer belt that is in contact with the image carriers, and is endlessly stretched over a plurality of rollers;

a primary transfer unit that transfers the toner images formed on the image carriers to the intermediate transfer belt;

a secondary transfer unit that transfers the toner images on the intermediate transfer belt to a recording medium;

a cleaning blade that removes a residual toner on the intermediate transfer belt after the secondary transfer unit transfers the toner images on the intermediate transfer belt to the recording medium; and a lubricant supplying unit that supplies a lubricant to at least one of the image carriers and the secondary transfer unit, so that the lubricant spreads to the intermediate transfer belt from at least one of the image carriers and the secondary transfer unit to which the lubricant is supplied, wherein the lubricant is spread to the intermediate transfer belt such that the lubricant reduces a surface friction coefficient to a level that does not harm primary transferability.

2. The image forming apparatus according to claim 1, wherein a toner image is formed between images as a blade input pattern, and the toner image of the blade input pattern is passed on to the cleaning blade.

3. The image forming apparatus according to claim 2, wherein an amount of the toner of the blade input pattern can be changed according to an image creation mode.

4. The image forming apparatus according to claim 3, wherein the amount of the toner of the blade input pattern is changed in such a manner that, when the image creation mode is set to a mode with which an efficiency of supplying the lubricant to the intermediate transfer belt from the image carriers or the secondary transfer unit is reduced, the amount of the toner of the blade input pattern is increased.

5. The image forming apparatus according to claim 3, wherein the amount of the toner of the blade input pattern is changed by changing an amount of adhering toner per unit area.

6. The image forming apparatus according to claim 3, wherein the amount of toner of the blade input pattern is changed by changing a size of an area of the blade input pattern.

7. The image forming apparatus according to claim 2, wherein an input interval of the blade input pattern can be changed according to an image creation mode.

8. The image forming apparatus according to claim 7, wherein the input interval of the blade input pattern is changed in such a manner that, when the image creation mode is set to a mode with which an efficiency of supplying the lubricant to the intermediate transfer belt from the image carriers or the secondary transfer unit is reduced, the input interval is shortened.

9. The image forming apparatus according to claim 1, wherein the lubricant supplying unit is provided in the secondary transfer unit.

10. The image forming apparatus according to claim 9, wherein a brush member is attached to the secondary transfer unit, the lubricant is supplied to the brush member from the lubricant supplying unit, and the lubricant is supplied to the secondary transfer unit from the brush member.

11. The image forming apparatus according to claim 9, wherein the lubricant is in a solid form, and the lubricant is supplied to the secondary transfer unit by bringing the secondary transfer unit into a direct contact with the lubricant.

12. The image forming apparatus according to claim 9, wherein the secondary transfer unit is always in contact with the intermediate transfer belt.

13. The image forming apparatus according to claim 12, further comprising a transfer-bias applying unit that applies a transfer bias to the secondary transfer unit, wherein the transfer bias between the images is set to a value lower than a value of the transfer bias during an image transfer.

14. An image forming apparatus, comprising:

a plurality of image carriers on each of which a toner image is formed based on image data;

an intermediate transfer belt that is in contact with the image carriers, and is endlessly stretched over a plurality of rollers;

a primary transfer unit that transfers the toner images formed on the image carriers to the intermediate transfer belt;

a secondary transfer unit that transfers the toner images on the intermediate transfer belt to a recording medium at once;

a cleaning blade that removes a residual toner on the intermediate transfer belt after the secondary transfer unit transfers the toner images on the intermediate transfer belt to the recording medium; and a lubricant supplying unit that supplies a lubricant to at least one of the image carriers and the secondary transfer unit, so that the lubricant is supplied to the intermediate transfer belt indirectly, wherein a toner image is formed between images as a blade input pattern;

the toner image of the blade input pattern is passed on to the cleaning blade; and an amount of the toner of the blade input pattern can be changed according to an image creation mode.

* * * * *